US005299950A

United States Patent [19]

Kaneko

[11] Patent Number: 5,299,950

[45] Date of Patent: Apr. 5, 1994

[54] SOCKET CONTACT

[75] Inventor: Tetsuya Kaneko, Tokyo, Japan

[73] Assignee: Yamaichi Electronics, Co., Ltd., Tokyo, Japan

[21] Appl. No.: 56,534

[22] Filed: May 5, 1993

[30] Foreign Application Priority Data

May 21, 1992 [JP] Japan ..... 4-155801

[51] Int. Cl.[5] ..... H01R 4/50

[52] U.S. Cl. ..... 439/342; 439/265; 439/856

[58] Field of Search ..... 439/259, 263, 265, 268, 439/266, 269, 342, 851, 856, 857, 861

[56] References Cited

U.S. PATENT DOCUMENTS

| | | | |
|---|---|---|---|
| 4,422,703 | 12/1983 | Christensen et al. | 439/266 |
| 4,648,669 | 3/1987 | Marks et al. | 439/266 X |
| 4,988,310 | 1/1991 | Bright et al. | 439/259 X |
| 5,092,789 | 3/1992 | Sinclair | 439/259 |
| 5,213,530 | 5/1993 | Uratsuji | 439/268 |

FOREIGN PATENT DOCUMENTS 63-4370 2/1988 Japan .

*Primary Examiner*—Larry I. Schwartz
*Assistant Examiner*—Khiem Nguyen
*Attorney, Agent, or Firm*—Wenderoth Lind & Ponack

[57] ABSTRACT

A contact socket having a first and a second elastic contact elements extending in an insertion direction (vertical direction) of a lead pin of an electric part, a lead pin loose insertion portion formed between and along opposite surfaces of the first and second elastic contact elements, and a narrowly-spaced lead pin clamping portion formed between the opposite surfaces, the lead pin inserted into the lead pin loose insertion portion being brought into the narrowly-spaced lead pin clamping portion by moving the lead pin in a horizontal direction, thereby assuring a reliable electrical contact, wherein a pair of normally-inclining slant sides for guiding the lead pin into the narrowly-spaced lead pin clamping portion from the lead pin loose insertion portion are formed between the lead pin loose insertion portion and the narrowly-spaced lead pin clamping portion, a pair of clamping sides forming the narrowly-spaced lead pin clamping portion are formed as reversely-inclining slant sides connected respectively at one ends thereof to one ends of the normally-inclining slant sides and gradually enlarging toward the other ends thereof, and positions of connecting areas between the pair of reversely-inclining slant sides forming the narrowly-spaced lead pin clamping portion and the pair of normally-inclining slant sides forming the lead pin guide portion are arranged in such a manner as being displaced in a horizontal direction from each other.

4 Claims, 5 Drawing Sheets

A

B

SOCKET CONTACT

BACKGROUND OF THE INVENTION

1. Field of the Invention

This invention relates generally to a socket contact in which lead pins of an electric part are loosely inserted with a small resistance into a space defined by opposite surfaces of a first and a second elastic contact elements along the opposite surfaces, and then the lead pins are horizontally moved from this loose insertion portion so as to be clamped, and more particularly to a socket contact which is suitably used to contact, for example, a pin grid array type integrated circuit (PGA type IC) having a number of lead pins projecting downwardly from a lower surface of a socket body.

2. Brief Description of the Prior Art

Japanese Utility Model Publication No. Sho 63-4370 discloses a socket contact used for the above PGA type IC. This socket contact has a first elastic contact element and a second elastic contact element both extending in a direction opposite to the insertion direction (vertical direction) of the lead pin of the IC. A lead pin loose insertion portion is formed between opposite surfaces of the first and second elastic contact elements, and a narrowly-spaced lead pin clamping portion is formed between the opposite surfaces of the first and second elastic contact elements. The lead pin inserted into the lead pin loose insertion portion with a small pressure is moved in a horizontal direction so as to be guided into the lead pin clamping portion where the lead pin is clamped by and between the first and second elastic contact elements to achieve an electrical contact. Between the lead pin loose insertion portion and the narrowly-spaced lead pin clamping portion, a pair of normally-inclining slant sides disposed in symmetric relation to each other are formed in order to guide the lead pin into the narrowly-spaced lead pin clamping portion.

For assuring a reliable electrical contact by means of prevention of the lead pin from accidentally moving toward the lead pin insertion side, a pair of reversely inclining clamping sides forming the narrowly-spaced lead pin clamping portion are provided.

As described above, according to the prior art, since the pair of normally-inclining slant sides are formed in order to guide the lead pin from the lead pin loose insertion portion to the narrowly-spaced lead pin clamping portion and this pair of slant sides is arranged in a symmetric relation relative to each other, the first and second elastic contact elements are simultaneously pressed so as to be spread outwardly against elasticity thereof at portions between the pair of slant sides and the pair of clamping sides. As a consequence, resistances caused by the first and second elastic contact elements are applied simultaneously to the first and second elastic contact elements, and an operating force for the movement of the lead pin is overly increased.

Particularly, in the case where the clamping sides forming the lead pin clamping portion are served as the reversely-inclining slant sides as mentioned above, the space of the clamping portion must be narrower at that end where the lead pin begins to be guided in. As a result, an operating force required for moving the lead pin into the lead pin clamping portion is more increased.

In other words, by forming the clamping sides of the lead pin clamping portion as reversely-inclining slant sides, a reliable contact can be assured by means of prevention of the lead pin from accidentally moving from the lead clamping portion to the lead pin loose insertion portion. This in turn gives rise to such a problem as to increase an introduction force into the lead pin clamping portion which eventually necessitates a large operating force.

SUMMARY OF THE INVENTION

It is therefore an object of the present invention to provide a socket contact in which a force for introducing a lead pin from a lead pin loose insertion portion to a lead pin clamping portion is reduced by half, and at the same time a reliable contact of the lead pin is assured at the lead pin clamping portion.

According to the present invention, there is provided, in order to achieve the above object, a contact socket having a first and a second elastic contact elements extending in an insertion direction (vertical direction) of a lead pin of an electric part, a lead pin loose insertion portion formed between and along opposite surfaces of the first and second elastic contact elements, and a narrowly-spaced lead pin clamping portion formed between the opposite surfaces, the lead pin inserted into the lead pin loose insertion portion being brought into the narrowly-spaced lead pin clamping portion by moving the lead pin in a horizontal direction, thereby assuring a reliable electrical contact, wherein a pair of normally-inclining slant sides for guiding the lead pin into the narrowly-spaced lead pin clamping portion from the lead pin loose insertion portion are formed between the lead pin loose insertion portion and the narrowly-spaced lead pin clamping portion, a pair of clamping sides forming the narrowly-spaced lead pin clamping portion are formed as reversely-inclining slant sides connected respectively at one ends thereof to one ends of the normally-inclining slant sides and gradually enlarging toward the other ends thereof, and positions of connecting areas between the pair of reversely-inclining slant sides forming the narrowly-spaced lead pin clamping portion and the pair of normally-inclining slant sides forming the lead pin guide portion are arranged in such a manner as being displaced in a horizontal direction relative to each other.

Distal end portions of the first and second elastic contact elements are inclined forwardly in an opposing direction relatively to each other, and the normally-inclining slant sides and the reversely-inclining slant sides are formed by edges of opposing surfaces side of the forwardly inclining end portions.

The distal end portion of one of the first and second elastic contact elements is located in a position higher than a distal end portion of the other.

Usually, a support element is provided along one side of each of the first and second elastic contact elements, and the lead pin loosely-insertion portion is formed between the support elements.

DETAILED DESCRIPTION OF THE EMBODIMENT

Figure 1:
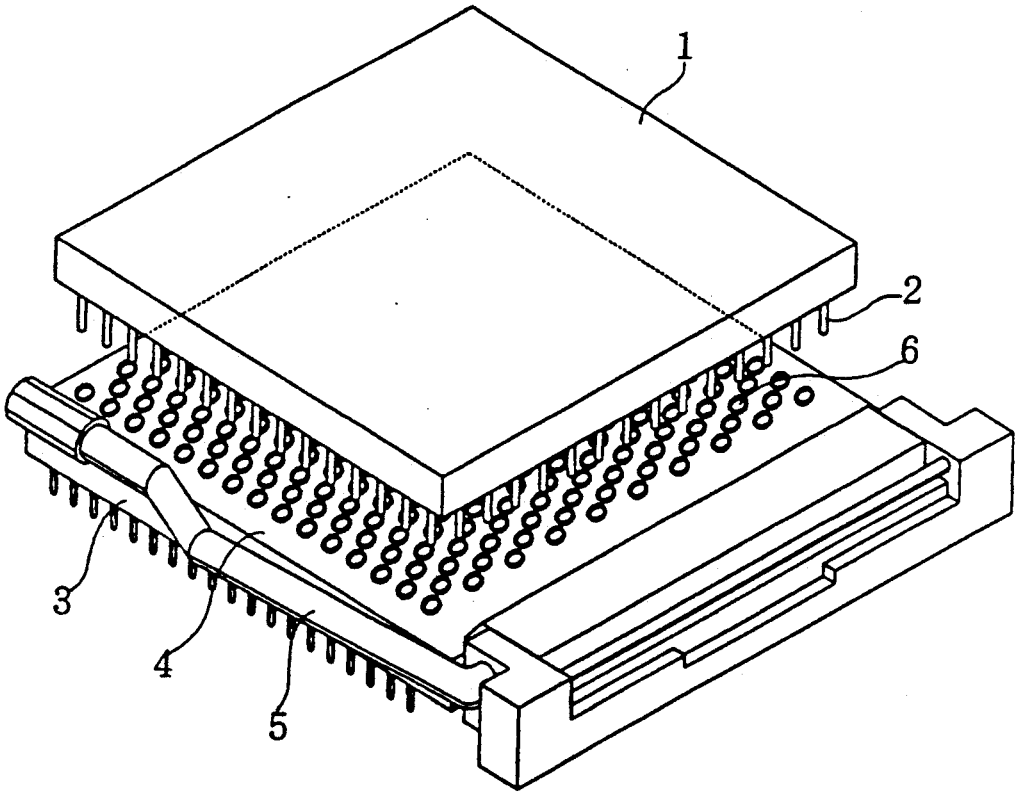
FIG. 1 is a perspective view exemplifying a socket incorporated with socket contacts of the present invention.
Figure 2:
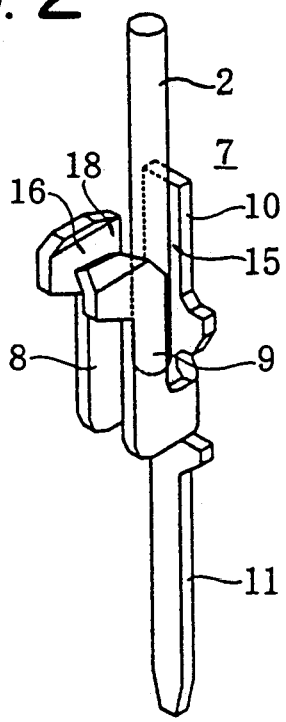
FIG. 2A is a perspective view exemplifying a socket contact according to one embodiment of the present invention.
FIG. 2B is a perspective view of the socket contact of FIG. 2A but with a lead pin clamped by the socket contact.
Figure 2:
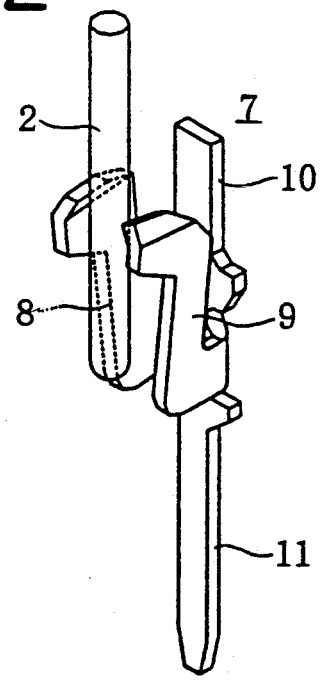
Figure 3:
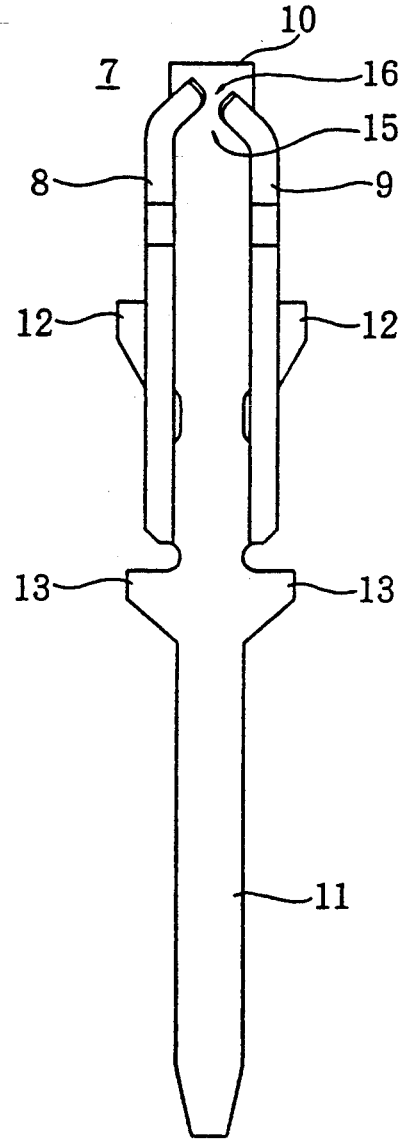
FIG. 3 is a front view of the above socket contact.

One embodiment of the present invention will be described hereinafter with reference to FIGS. 1 through 7. FIG. 1 shows, as a typical example of an electric part, a PGA type IC as well as a socket used for the IC. The numeral 1 denotes the PGA type IC having lead pins 2 consisting of a number of round pins densely projecting from a lower surface of an IC body. The socket comprises a socket body 3, and a placing plate 4 horizontally movably superimposed on an upper surface of the socket body 3. The horizontal movement of the placing plate 4 is achieved by operation of a crank lever 5. When the IC 1 is placed on the placing plate 4, the number of IC lead pins 2 extend through a number of holes formed in the placing plate 4. On the other hand, the socket body is provided with a number of socket contacts 7 capable of contacting the IC lead pins 2. The IC lead pins 2 are brought into contacting position and releasing position in accordance with the horizontal movement of the placing plate 4.

As shown in FIGS. 2A to 5, each socket contact 7 includes a first elastic contact element 8 and a second elastic contact element 9 both extending in an opposite direction relative to an insertion direction (vertical direction) of each lead pin 2. The socket contact 7 further includes a support element 10 disposed at one sides of and extending along the first and second elastic contact elements 8 and 9. The first and second elastic contact elements 8 and 9 and the support element 10 are connected to each other at basal portions thereof. The socket contact 7 further includes a male terminal 11 extending downwardly from the connecting area between the first and second elastic contact elements 8 and 9 and the support element 10.

The support element 10 is formed with a pair of press-fit lugs 12 projecting sidewardly from opposite sides thereof upper than the contacting area, while the male contact is formed of a pair of press-fit lugs 13 projecting sidewardly from opposite sides thereof lower than the connecting area. The socket contact 7 is pressure fitted into a contact retaining hole 14 formed in the socket body 3 by the press-fit lugs 12 and 13, and opposite side edges of the support element 10 are restricted by opposite inner surfaces of the contact retaining hole 14, thereby preventing a detrimental inclination of the socket contact 7.

A lead pin loosely insertion portion 15 is formed between and along opposite surfaces of the first and second elastic contact elements 8 and 9 (that is, along an inner surface of the support element 10), and a narrowly-spaced lead pin clamping portion 16 is formed between the opposite surface of the first and second elastic contact elements 8 and 9. The IC lead pin 2 is inserted into the lead pin loosely insertion portion 15 through the hole 6 with a small resistance, and then horizontally moved from the lead pin loosely insertion portion 15 so as to be brought into the narrowly-spaced lead pin clamping portion 16 against elasticity of the first and second elastic contact elements 8 and 9, thereby achieving an electrical contact. On the contrary, by moving the lead pin 2 from the narrowly-spaced lead pin clamping portion 16 to the lead pin loosely insertion portion 15, the IC 1 can be removed with a small resistance.

As previously described, the socket has the crank lever 5, and the placing plate 4 as means for horizontally moving the placing plate 4. By turning this crank lever 5, the placing plate 4 and the IC 1 are horizontally moved, thereby reciprocating the lead pin 2 between the lead pin loosely insertion portion 15 and the narrowly-spaced lead pin clamping portion 16.

Figure 4:
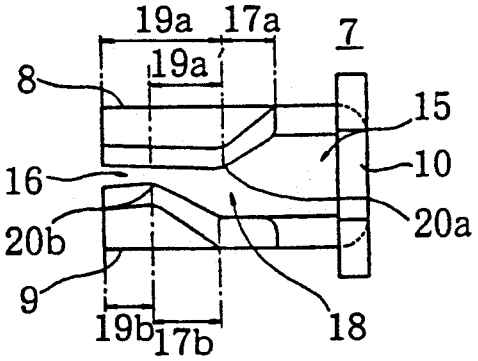
FIG. 4 is a plan view of the above socket contact.
Figure 5:
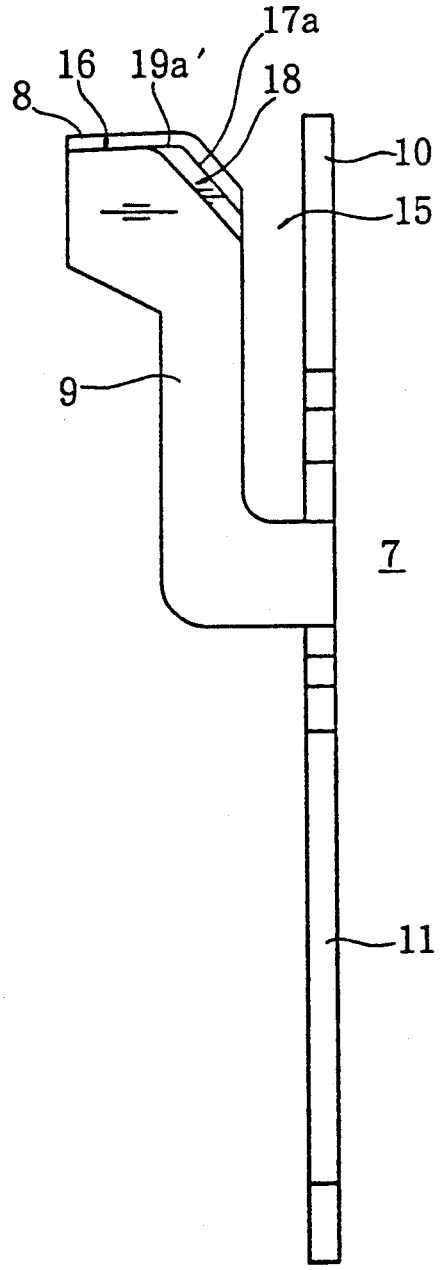
FIG. 5 is a side view of the above socket contact.

As shown in FIG. 4, the socket contact 7 includes a pair of normally-inclining slant sides 17*a* and 17*b* formed between the lead pin loosely insertion portion 15 and the narrowly-spaced lead pin clamping portion 16 and converging toward the narrowly-spaced lead pin clamping portion 16 from the lead pin loosely insertion portion 15. A lead pin guide portion 18 is formed between the normally-inclining slant sides 17*a* and 17*b*. The lead pin 2 is brought to the narrowly-spaced lead pin clamping portion 16 guided from the lead pin loosely insertion portion 15 by the normally-inclining slant sides 17*a* and 17*b*.

As a pair of clamping sides forming the narrowly-spaced lead pin clamping portion 16, there are provided a pair of reversely-inclining slant sides 19*a* and 19*b* connected respectively at one ends thereof to one ends of the normally-inclining slant sides 17*a* and 17*b* and gradually enlarging toward the other ends thereof.

One of the reversely-inclining slant sides, i.e., the slant side 19*a* is connected to one of the normally-inclining slant sides 17*a* and 17*b*, i.e., the slant side 17*a*, and the other reversely-inclining slant side 19*b* is connected to the other normally-inclining slant side 17*b*. Connecting areas between the reversely-inclining slant side 19*a* and the normally-inclining slant side 17*a* and between the reversely-inclining slant side 19*b* and the normally-inclining slant side 17*b* are formed respectively with projections 20*a* and 20*b* projecting toward their opposite surfaces.

The connecting area between the reversely-inclining slant side 19*a* and the normally-inclining slant side 17*a* is horizontally displaced relative to the connecting area between the reversely-inclining slant side 19*b* and the normally-inclining slant side 17*b*. This means that the projections 20*a* and 20*b* are horizontally displaced relative to each other.

Specifically, the pair of normally-inclining slant sides 17*a* and 17*b* forming the lead pin guide portion 18 are in horizontally-displaced relation to each other, and the reversely-inclining slant sides 19*a* and 19*b* forming the narrowly-spaced lead pin clamping portion 16 are likewise in horizontally-displaced relation to each other.

More specifically, the normally-inclining slant sides 17*a* and 17*b* forming the lead pin guide portion 18 are in displaced relation to each other at least their end portions on the narrowly-spaced lead pin clamping portion 16 side, and the reversely-inclining slant sides 19*a* and 19*b* are likewise in displaced relation to each other at their end portions on the lead pin guide portion 18 side. Accordingly, one end of the reversely-inclining slant side 19*a* of the first elastic contact element 8 forming the narrowly-spaced lead pin clamping portion 16 extend so far as a position opposite to the normally-inclining slant side 17*b* and is connected to the normally-inclining slant side 17*a*.

In other words, the entirety or one end of the normally-inclining slant side 17b of the second elastic contact element 9 extend so far as the position opposite to the reversely-inclining slant side 19a.

Reference numeral 19a' denotes an inclining end portion of the reversely-inclining slant side 19a corresponding to the normally-inclining slant side 17b. This inclining end portion 19' is served to reduce resistance at the time the lead pin 2 is caused to climb over the projection 20b. As mentioned, the projections 20a and 20b are in horizontally-displaced relation to each other.

The lead pin guide portion 18 and the narrowly-spaced lead pin clamping portion 16 are formed at distal end portions of the first and second elastic contact elements 8 and 9. In other words, the distal end portions of the first and second elastic contact elements 8 and 9 are inclined forwardly toward the opposite surfaces at a predetermined angle, and the normally-inclining slant sides 17a and 17b and the reversely-inclining slant sides 19a and 19b are constructed by opposite surfaces side edges (inner surfaces side edges) of the forwardly-inclining portions. The lead pin guide portion 18 is formed between the normally-inclining slant sides 17a and 17b, and the narrowly-spaced lead pin clamping portion 16 is formed between the reversely-inclining slant sides 19a and 19b. At the same time, a difference in height is established between the distal end portions of the first and second elastic contact elements 8 and 9. Accordingly, an inner edge of the first elastic contact element 8 and an inner edge of the second elastic contact element 9 are different in height relative to each other, and the two edges are capable of contacting axially different parts of the lead pin 2.

In the illustrated example, the lead pin loosely insertion portion 15 is situated outside the area between the opposite surfaces of the first and second elastic contact elements 8 and 9. Alternatively, the lead pin loosely insertion portion 15 may be situated inside the area between the opposite surfaces of the first and second elastic contact elements 8 and 9. In other words, the lead pin loosely insertion portion 15 may be situated inside or outside the area between the opposite surfaces of the first and second elastic contact elements 8 and 9.

Figure 6A:
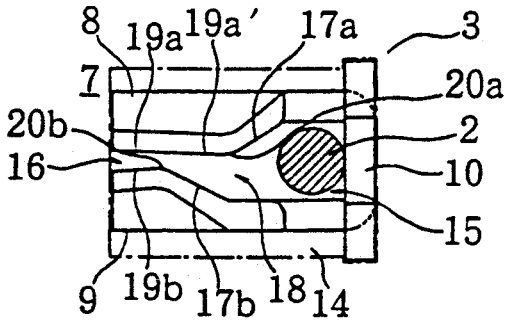
FIGS. 6A, 6B, 6C, 6D, 6E are plan views for explaining step-wise the actions of the above socket contact.
Figure 6B:
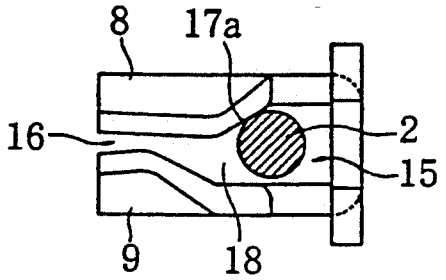
Figure 6C:
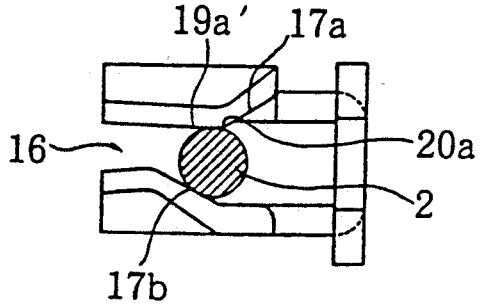
Figure 6D:
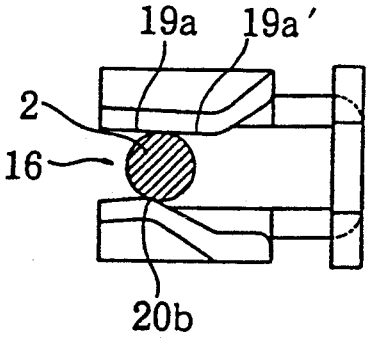
Figure 6E:
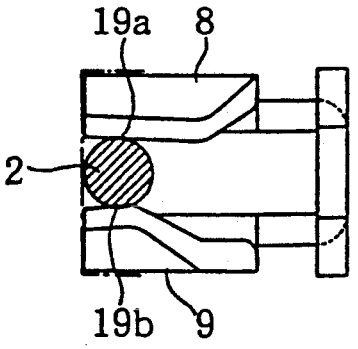
Figure 7E:
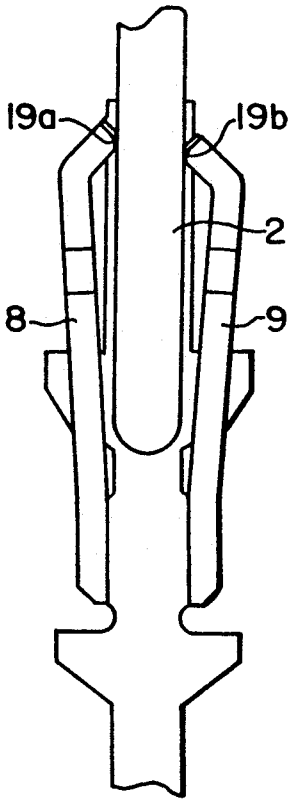
FIGS. 7A, 7B, 7C, 7D, 7E are front views showing the actions of the above socket contact in such a manner as to correspond to the actions of FIGS. 6A to 6E.
Figure 7D:
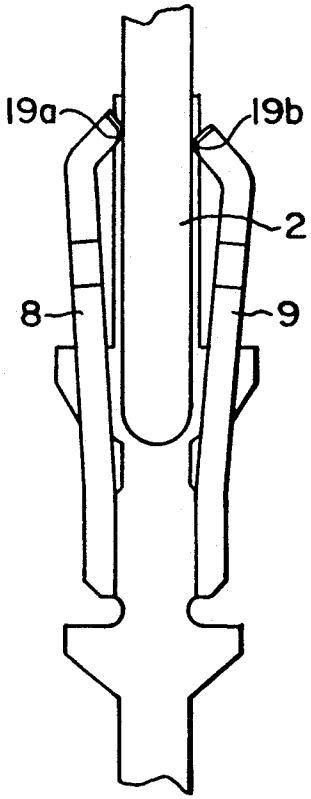
Figure 7C:
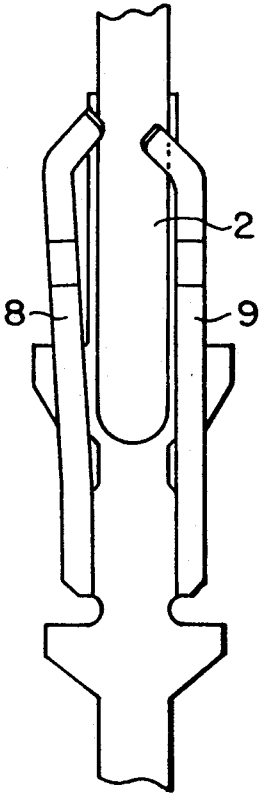
Figure 7B:
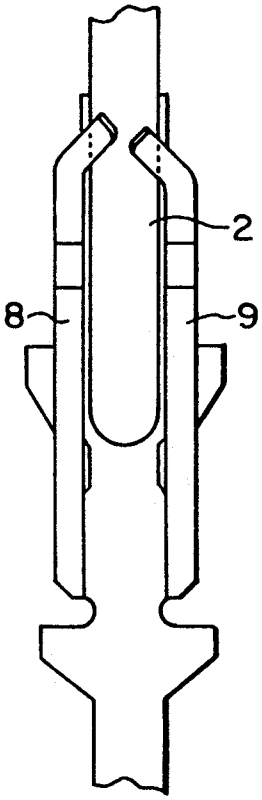
Figure 7A:
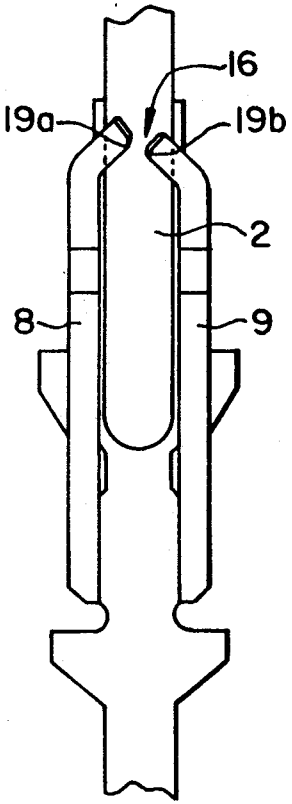

A construction of the present invention will be described in more detail with reference to FIGS. 6A to 6E and FIGS. 7A to 7E showing the actions of the component parts of the present invention. In FIGS. 6A and 7A, the lead pin 2 is inserted into the lead pin loosely insertion portion 15. Then, the lead pin 2 is horizontally moved from the lead pin loosely insertion portion 15. As shown in FIGS. 6B and 7B, first, the lead pin 2 is brought into contact with the normally-inclining slant side 17a of the first elastic contact element 8. Then, as shown in FIGS. 6C and 7C, when the lead pin 2 is horizontally moved guided by the slant side 17a, and caused to climb over the projection 20a while displacing the first elastic contact element 8 outwardly, so as to be brought to the inclining end portion 19a'. At the same time, the lead pin 2 is brought into abutment with the normally-inclining slant side 17b of the second elastic contact element 9.

As shown in FIGS. 6D and 7D, when the lead pin 2 is horizontally moved guided by the normally-inclining slant side 17b, the lead pin 2 is caused to climb over the other projection 20b and brought to the reversely-inclining slant side 19b while displacing the second elastic contact element 9 outwardly. At this time, the inclining end portion 19a' of the reversely-inclining slant side 19a is served as means for enhancing the introduction of the lead pin 2 to the narrowly-spaced lead pin clamping portion 16.

In this way, as shown in FIGS. 6E and 7E, the lead pin 2 is further moved horizontally from the position of FIGS. 6D and 7D guided by the pair of reversely-inclining slant sides 19a and 19b, and clamped by and between the reversely-inclining slant sides 19a and 19b. In other word, the lead pin 2 is elastically clamped by and between the first and second elastic contact elements 8 and 9, thereby achieving an electrical contact.

The reversely-inclining slant sides 19a and 19b are served as means for enhancing the introduction of the lead pin 2 at the time the lead pin 2 is introduced from the lead pin guide portion 18, and also as means working against the movement of the lead pin 2 from the narrowly-spaced lead pin clamping portion 16 toward the lead pin guide portion 18.

According to the present invention, when the lead pin 2 is moved from the lead pin loosely insertion portion 15 to the narrowly-spaced lead pin clamping portion 16, the lead pin 2 is caused to climb over the projection 20a formed on the connecting area between the normally-inclining slant side 17a and the reversely-inclining slant side 19a to displace the first elastic contact element 8 outwardly, and thereafter caused to climb over the other projection 20b formed on the connecting area between the other normally-inclining slant side 17b and the other reversely-inclining slant side 19b. Accordingly, the resistances of the first and second elastic contact elements 8 and 9 (i.e. resistances of the projections 20a and 20b) are applied to lead pin 2 with a time lag at the time the lead pin 2 is moved from the lead pin loosely insertion portion 15 to the narrowly-spaced lead pin clamping portion 16. As a result, there can be eliminated the problem inherent to the prior art that the first and second elastic contact elements 8 and 9 are applied simultaneously to the lead pin 2 to increase the operating load.

The lead pin 2 is in contact with the reversely-inclining slant side 19a when the lead pin 2 is caused to climb over the projection 20b formed on the connecting area between the normally-inclining slant side 17b and the reversely-inclining slant side 19b after the lead pin 2 is caused to climb over the projection 20a formed on the connecting area between the normally-inclining slant side 17a and the reversely-inclining slant side 19a. Accordingly, the reversely-inclining slant side 19a is served to enhance the introduction of the lead pin 2 to the narrowly-spaced lead pin clamping portion 16, thus enabling for the lead pin 2 to climb over the projection 20b with a reduced operating force. In addition, by virtue of the provision of the pair of reversely-inclining slant sides 19a and 19b, the lead pin 2 can be effectively prevented from being moved accidentally to the lead pin loosely insertion portion 15 from the narrowly-spaced lead pin clamping portion 16.

That is, according to the present invention, the lead pin can be moved from the lead pin loosely insertion portion to the narrowly-spaced lead pin clamping portion with a small resistance, and the lead pin is positively held by the narrowly-spaced lead pin clamping portion, thereby assuring a more reliable contact.

While the present invention has been described in the form of one preferred embodiment, it should of course be understood that the invention is not limited to this embodiment but various changes and modifications can be made without departing from the scope of the present invention as defined by the appended claims.

What is claimed is:

1. A contact socket having a first and a second elastic contact elements extending in an insertion direction (vertical direction) of a lead pin of an electric part, a lead pin loose insertion portion formed between and along opposite surfaces of said first and second elastic contact elements, and a narrowly-spaced lead pin clamping portion formed between said opposite surfaces, said lead pin inserted into said lead pin loose insertion portion being brought into said narrowly-spaced lead pin clamping portion by moving said lead pin in a horizontal direction, thereby assuring a reliable electrical contact, wherein a pair of normally-inclining slant sides for guiding said lead pin into said narrowly-spaced lead pin clamping portion from said lead pin loose insertion portion are said narrowly-spaced lead pin clamping portion, a pair of clamping sides forming said narrowly-spaced lead pin clamping portion are formed as reversely-inclining slant sides connected respectively at one ends thereof to one ends of the normally-inclining slant sides and gradually enlarging toward the other ends thereof, and positions of connecting areas between said pair of reversely-inclining slant sides forming said narrowly-spaced lead pin clamping portion and said pair of normally-inclining slant sides forming said lead pin guide portion are arranged in such a manner as being displaced in a horizontal direction from each other.

2. A socket contact as claimed in claim 1, wherein distal end portions of said first and second elastic contact elements are inclined forwardly in an opposing direction relatively to each other, and the normally-inclining slant sides and the reversely-inclining slant sides are formed by edges on opposing surfaces side of the forwardly inclining end portions.

3. A socket contact as claimed in claim 1 or 2, wherein a distal end portion of one of said first and second elastic contact elements is located in a position higher than a distal end portion of the other.

4. A socket contact as claimed in claim 1 or 2, wherein a support element is provided along one side of each of said first and second elastic contact elements, and said lead pin loosely-insertion portion is formed between said support elements.

* * * * *